US005360072A

United States Patent [19]

Lange

[11] Patent Number: 5,360,072

[45] Date of Patent: Nov. 1, 1994

[54] DRILL RIG HAVING AUTOMATIC SPINDLE STOP

[76] Inventor: James E. Lange, P.O. Box 1670, LaPorte, Ind. 46350

[21] Appl. No.: 53,544

[22] Filed: Apr. 26, 1993

[51] Int. Cl.[5] ..... E21B 19/00; B23B 49/00

[52] U.S. Cl. ..... 173/2; 173/176; 408/241 G; 408/710; 409/134; 74/613

[58] Field of Search ..... 173/2, 4, 5, 6, 176; 408/5, 9, 10, 241 G, 710; 409/134; 166/363; 56/10.5; 74/608, 609, 612, 613; 83/397

[56] References Cited

U.S. PATENT DOCUMENTS

| | | | |
|---|---|---|---|
| 3,783,709 | 1/1974 | Scott | 74/612 |
| 3,939,749 | 2/1976 | Müller et al. | 83/397 |
| 4,033,218 | 7/1977 | Donatelle | 83/397 |
| 4,132,497 | 1/1979 | Weller et al. | 408/710 |
| 4,137,795 | 2/1979 | Lindquist | 74/613 |
| 4,552,494 | 11/1985 | Wix | 74/612 |
| 4,825,962 | 5/1989 | Girault | 173/2 |
| 5,085,280 | 2/1992 | Rassieur | 173/176 |
| 5,265,497 | 11/1993 | Curless | 409/134 |

*Primary Examiner*—Scott Smith
*Attorney, Agent, or Firm*—James D. Hall

[57] ABSTRACT

A drill rig which is equipped with one or more safety mechanisms designed to prevent injuries to rig operators. In a first embodiment, the safety mechanism includes a barrier which is shiftably mounted to the rig and surrounds the drilling tool when the barrier is in the closed position. The barrier includes a key member which must be fitted into a sensor-equipped keyhole in the rig for the drilling tools to operate. A brake may also be connected to the drill spindle to stop rotation until the barrier is closed. In a second embodiment, a sensor is connected to a delay timer. The sensor is also connected to the clutch and transmission and alerts the operator that the clutch is disengaged but the transmission is not in neutral by sounding a warning buzzer after a predetermined time. If the operator fails to actuate a disconnect switch by shifting to a neutral position within a second predetermined time, a second delay timer activates to shut off the engine. A brake may also be connected between the spindle and the delay timer to prevent spindle rotation.

9 Claims, 7 Drawing Sheets

DRILL RIG HAVING AUTOMATIC SPINDLE STOP

FIELD OF THE INVENTION

This invention relates to drill rigs and will have application to drill rigs with incorporated safety features.

BACKGROUND OF THE INVENTION

Accidents during commercial drilling operations are of great concern to safety organizations, labor unions, equipment suppliers, and most importantly rig operators. The most common accidents, as well as the most damaging, occur when the drill rig operator becomes entangled with the rotating drilling tools. Every year, drill rig operators lose limbs, and in some cases their lives, through carelessness and the lack of any currently available safety devices which automatically cut the power to the spindle in the event of an accident.

U.S. Pat. No. 5,085,280 discloses a shut-off mechanism for a drill rig which allows the drill operator to manually cut power to the drill spindle by tripping a wobble-type switch. While the drill rig of the '280 patent provides for an effective means for limiting the injuries suffered during an accident, neither that rig nor any other rigs currently on the market can prevent an accident before it happens. Additionally, kill switches of this type assume the operator will not panic and forget about the switch during an accident. Since the operator has only a very short time to react after the accident occurs, many operators can be seriously injured or killed even on rigs which have these safety features.

SUMMARY OF THE INVENTION

The drill rig of this invention incorporates a preventative safety device which stops accidents before they occur. In a first embodiment, the rotating spindle is surrounded by a protective barrier which prevents the operator from making contact with the spindle while it is rotating. In a second embodiment, a delay timer and kill switch shuts off the rotating spindle after a short period of time unless the operator disables the kill switch at a location spaced from the drill spindle.

Both of these embodiments are designed to provide for maximum safety and prevent the operator from exposing himself to a rotating spindle when the transmission is not in neutral. In addition, both embodiments may include a brake attached to the spindle which will immediately halt movement of the spindle upon actuation of the kill switch.

In the first embodiment, the protective shield includes a key which must be inserted into a sensor-equipped key hole to disable the trip switch and allow the spindle to operate. The key may only be inserted into the key hole when the shield is in a closed position.

Accordingly, it is an object of this invention to provide for a drill rig which incorporates an accident preventative safety device.

Another object is to provide for a drill rig which automatically cuts power to the spindle unless the protective shield is in a closed position.

Another object is to provide for a drill rig which immediately stops the spindle when the shield is open and the transmission is not in neutral.

Another object is to provide for a drill rig which meets or exceeds state enacted safety regulations.

Another object is to provide for a safety device which can be easily and economically retrofitted onto almost all commercially available drill rigs.

Other objects will become apparent upon a reading of the following description.

DESCRIPTION OF THE PREFERRED EMBODIMENT

Figure 1:
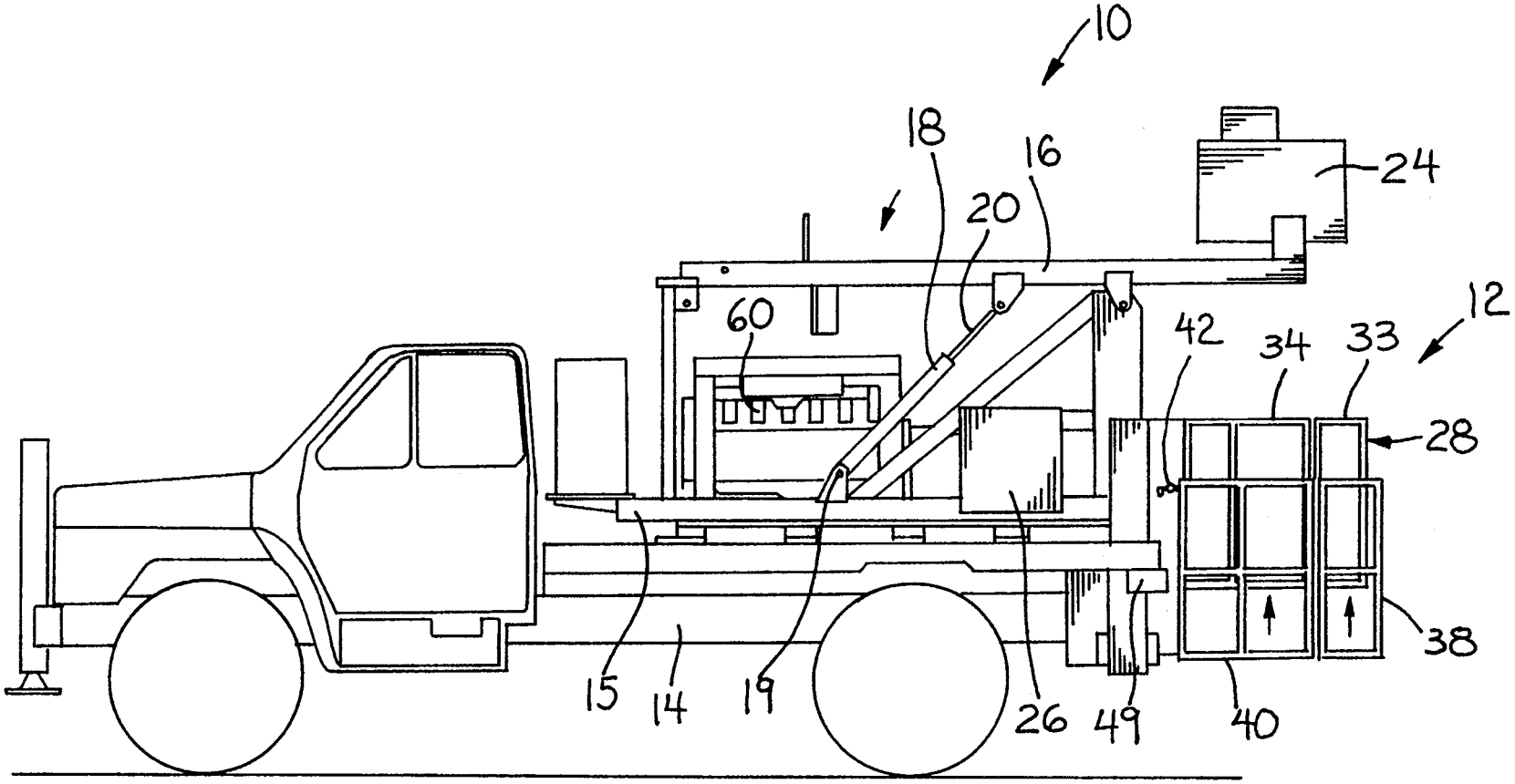
FIG. 1 is an elevation view of the drill rig of this invention with the barrier up and in their open position.

The preferred embodiments herein described are not intended to be exhaustive or to limit the invention to the precise forms disclosed. They are chosen and described to explain the principles of the invention and its application and practical use to enable others skilled in the art to utilize its teachings.

Referring first to FIGS. 1–5, reference numeral 10 generally designates a drill rig which incorporates the safety device 12 of this invention. Drill rig 10 is shown mounted to a flat bed truck 14. However, safety device 12 may be fitted onto any type of rig which utilizes a support frame and a rotating spindle which turns drilling tools.

Figure 2:
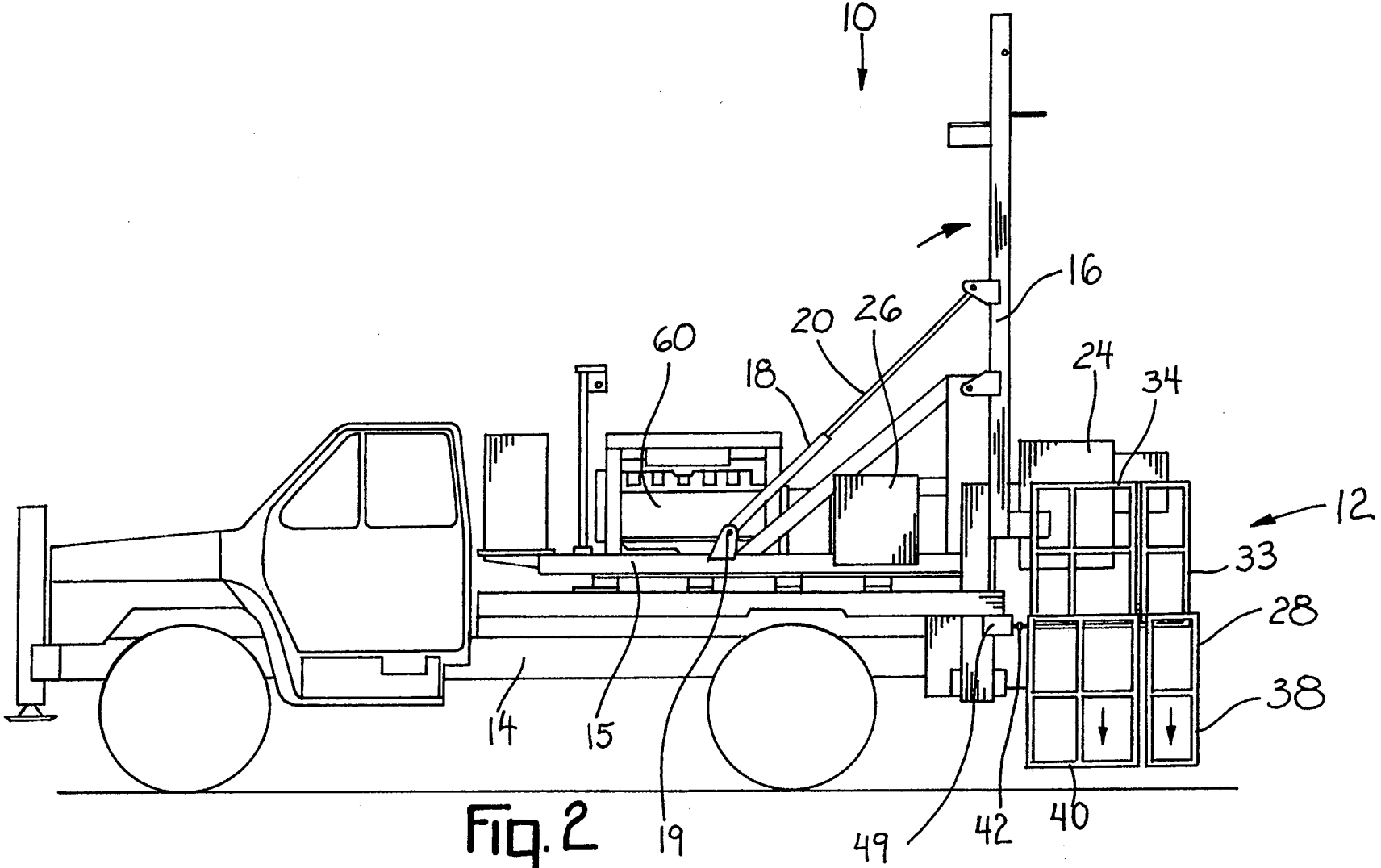
FIG. 2 is an elevation view of the rig illustrating the protective shield in its closed position.

As shown in the drawings, rig 10 includes a spindle support frame 16 which is pivotally mounted to rig frame 15 by hydraulic cylinders 18 and pivot pins 19. Cylinders 18 each include extensible rod 20 for shifting the spindle support frame between a travel position (FIG. 1) and an operating position (FIG. 2). Spindle 22 is rotatably housed in bearing blocks 24 connected to frame 16 and is connected mechanically to gear box 26. Spindle 22 may also be hydraulically driven, if desired. Thus far, the description of drill rig 10 is of a conventionally available drill rig and will not be expounded upon for purposes of clarity.

Figure 3:
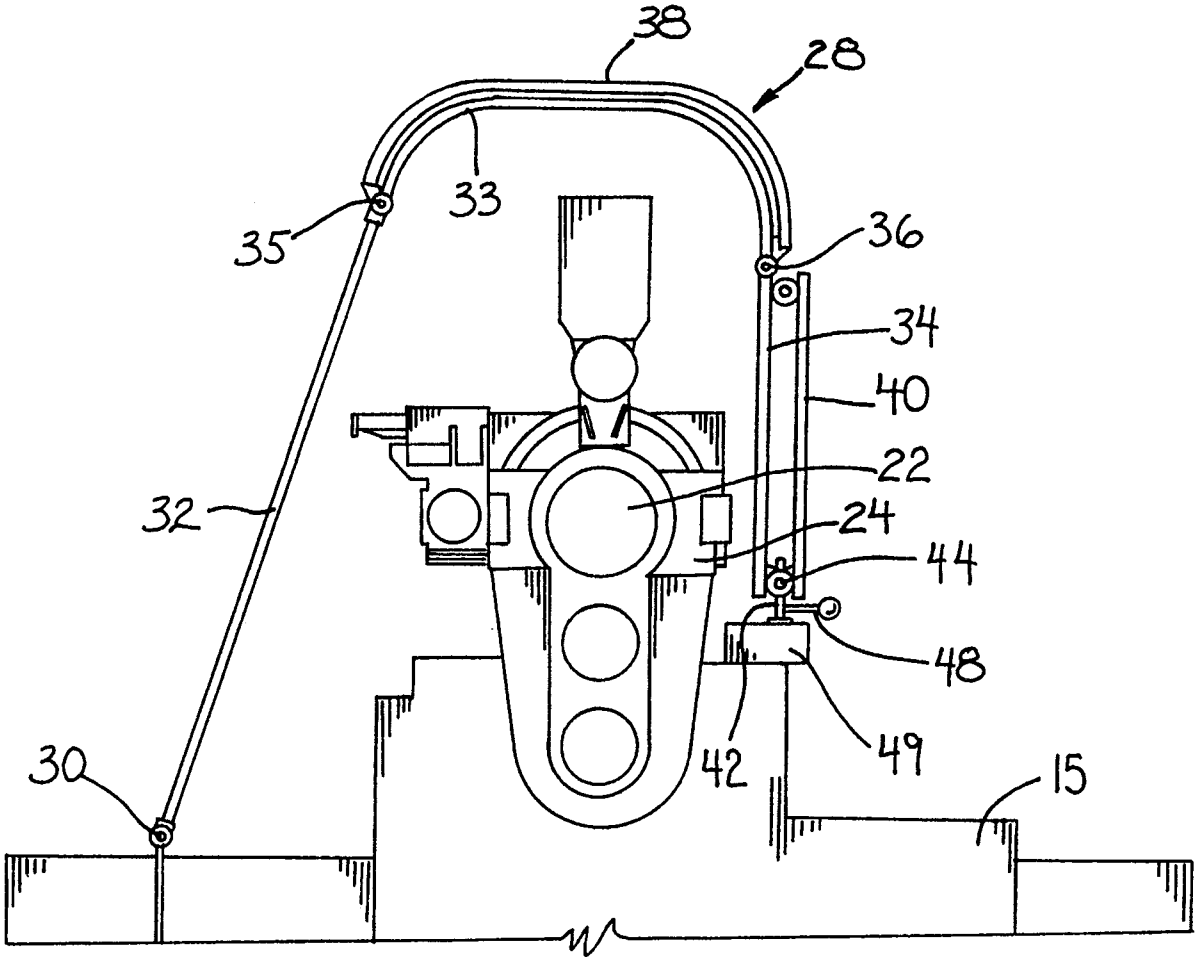
FIG. 3 is a top plan view of the rig of FIG. 2.
Figure 4:
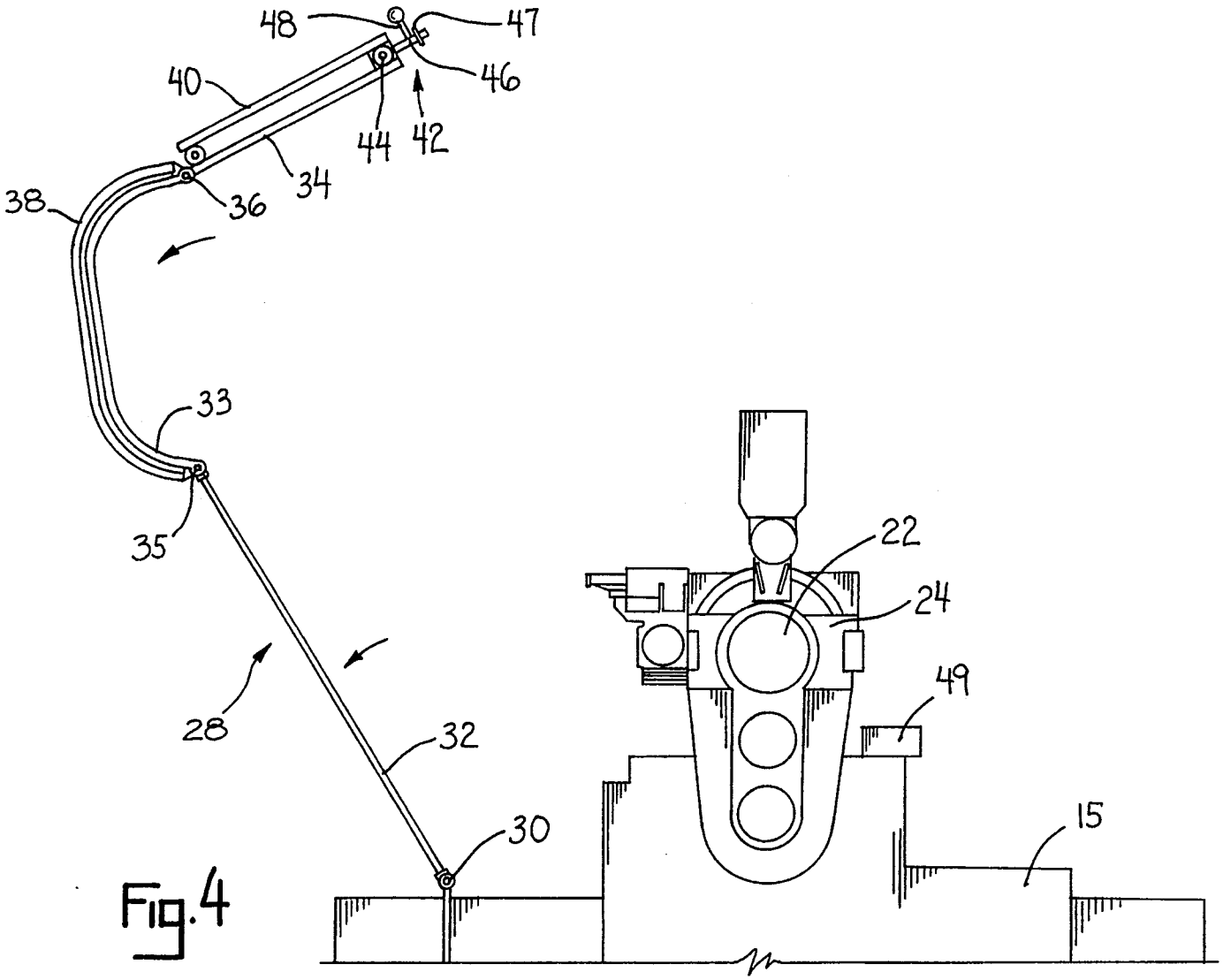
FIG. 4 is a top plan view of the rig of FIG. 1.
Figure 6:
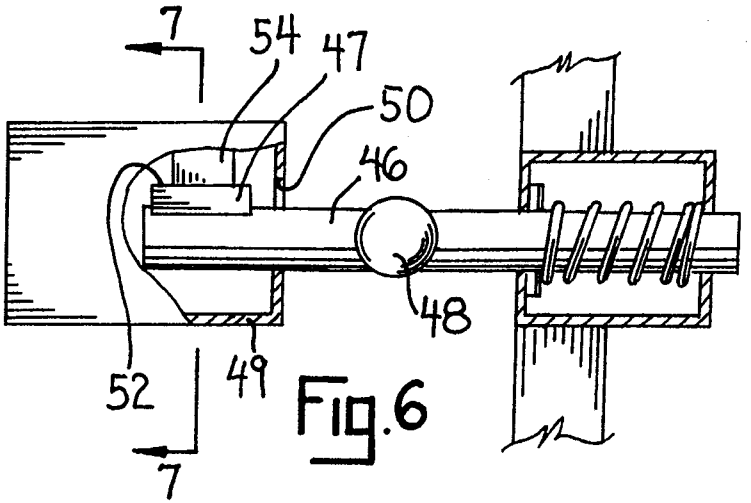
FIG. 6 is a fragmented elevation view of the key and keyhole with the key inserted.
Figure 7:
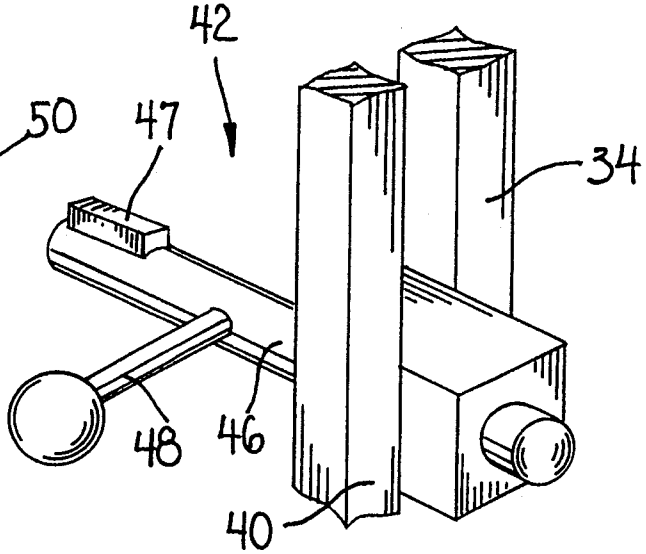
FIG. 7 is a sectional view taken along line 7—7 of FIG. 6.
Figure 7:
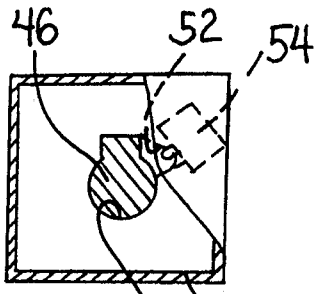
Figure 5:
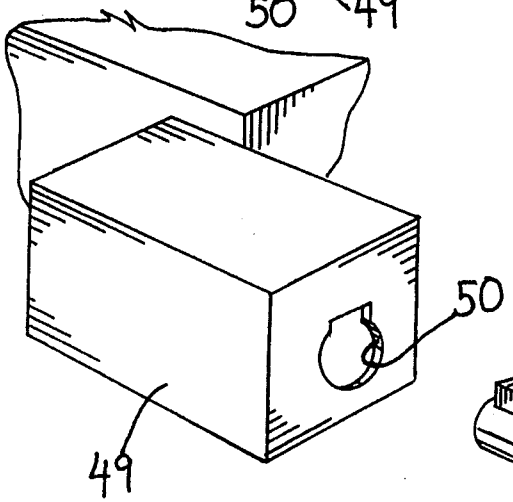
FIG. 5 is a detail exploded view of the barrier key and keyhole.

As shown in FIGS. 1–4, safety device 12 includes a shield or barrier 28. Barrier 28 is preferably connected to rig frame 15 as by pivot pin 30. Barrier 28 may consist of a solid wall or may resemble a cage-like structure as shown in the drawings. As depicted, barrier 28 may include three sections 32, 33 and 34 which are interconnected for correlative movement by pivot pins 35 and 36. Alternatively, barrier 28 may be constructed of a single section or any number of sections pivotally connected to each other to allow for rapidity of shifting between the open position (FIG. 4) and the closed position (FIG. 3).

As shown in the drawings, barrier 28 may also include sections 38 and 40 which are slidably connected to sections 33 and 34, respectively. Sections 38, 40 are slidable relative to sections 32–34 between a raised road travel position (FIG. 1) and an operating position (FIG. 2). The sliding connection (not shown) may be accomplished by any one of a number of common slide type fasteners.

A key 42 is rotatably connected to barrier section 40 as by pivot pin 44 or other suitable fastener. Key 42 preferably includes a shank 46 and turn handle 48 with a protrusion 47 extending outwardly from shank 46.

Rig frame 15 preferably includes a keybox 49 which has a keyhole 50 which is configured so as to accept key 42 and to accommodate rotation of the shank 46 and its projection 47. Keyhole 50 has an inner slot 52 into which protrusion may be turned. A sensor 54, which may consist of a limit switch, a Hall effect sensor or any other common position detector is housed in keybox 49 and is positioned so as to detect the presence of protrusion 47 in slot 52 as key 42 is rotated.

Figures 8A, 8B, 8C, 8D:
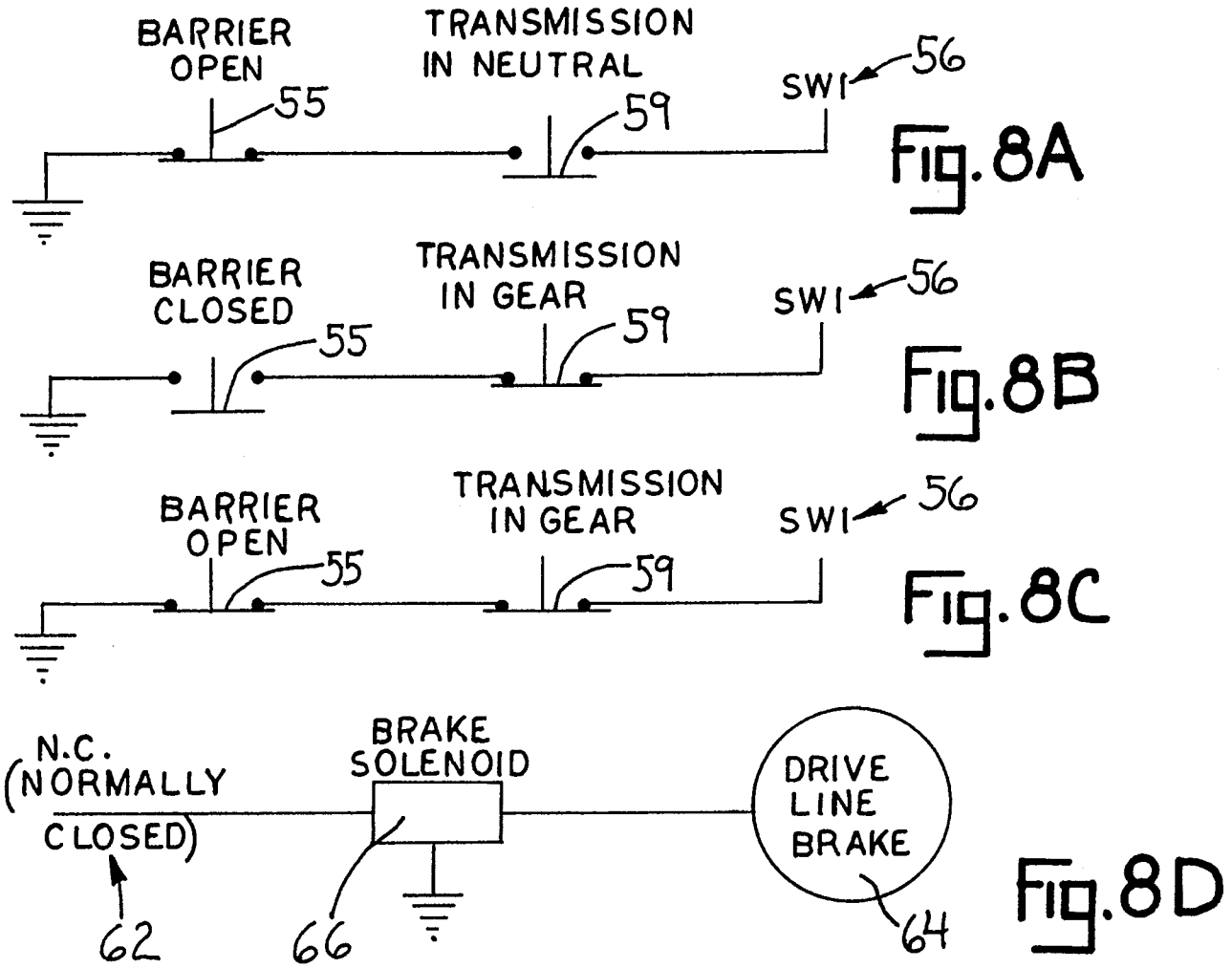
FIGS. 8A, 8B, 8C and 8D are schematic representations of the electronics used in the drill rig of FIGS. 1–4.

As shown in the schematical representations of FIGS. 8A–8C, sensor 54 is electrically connected in series to a switch 55 and to kill switch 56, and a switch 59 which is connected to a sensor (not shown) which detects the orientation of the transmission (not shown) housed in gear box 26. Kill switch 56 is connected directly to the engine 60 which powers the transmission to rotate spindle 22.

As shown in FIG. 8D, a brake switch 62 may also be connected to the above circuit to operate a spindle brake 64 through activation of brake solenoid 66. The details of the construction and positioning of spindle brake 64 and solenoid 66 are well known and will not be described further.

The operation of drill rig 10 which is equipped with safety device 12 is as follows. While rig 10 is not being operated, barrier sections 38–40 are normally kept in the raised position of FIG. 2 to allow for road travel. When it is desired to operate rig 10, sections 38–40 are lowered and pivoted into the closed position of FIG. 1. Key 42 is inserted into keyhole 50 and turned so that sensor 54 detects the presence of projection 47 to open and deactivate kill switch 56.

If at any time during rig operation, the barrier 28 is opened while the transmission is not in a neutral position, sensors 54 and 58 operate to close their respective switches 55, 59 and activate kill switch 56. This disables engine 60 (usually by cutting off fuel flow via a fuel solenoid) and stops rotation of spindle 22. If brake switch 62 is employed, this will also activate brake solenoid 66 and cause brake 64 to immediately halt rotation of spindle 22. When the transmission is shifted into neutral as the barrier 28 is again closed and key 42 properly positioned in keyhole 50, engine 60 can be restarted.

Figure 9:
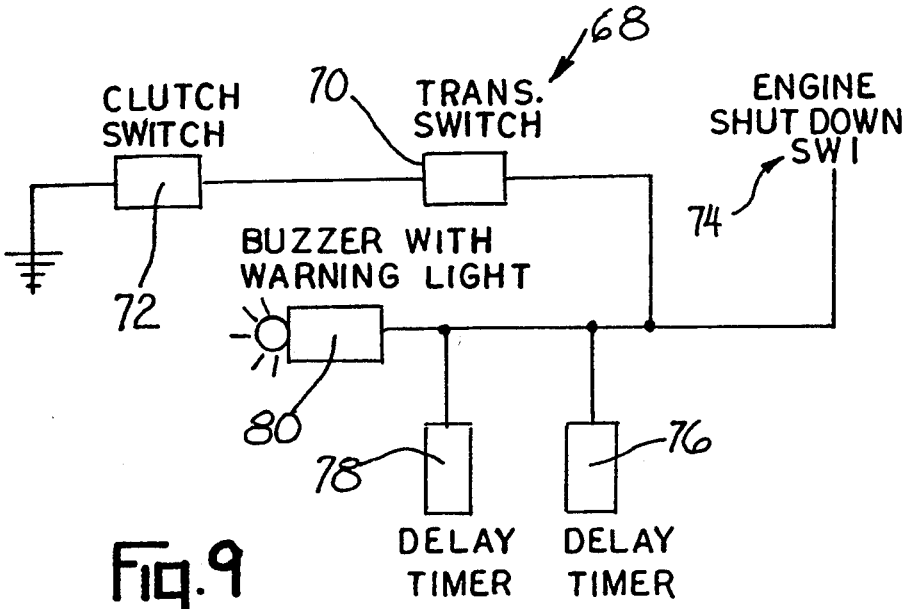
FIG. 9 is a schematic representation of a second embodiment of the drill rig.
Figure 10:
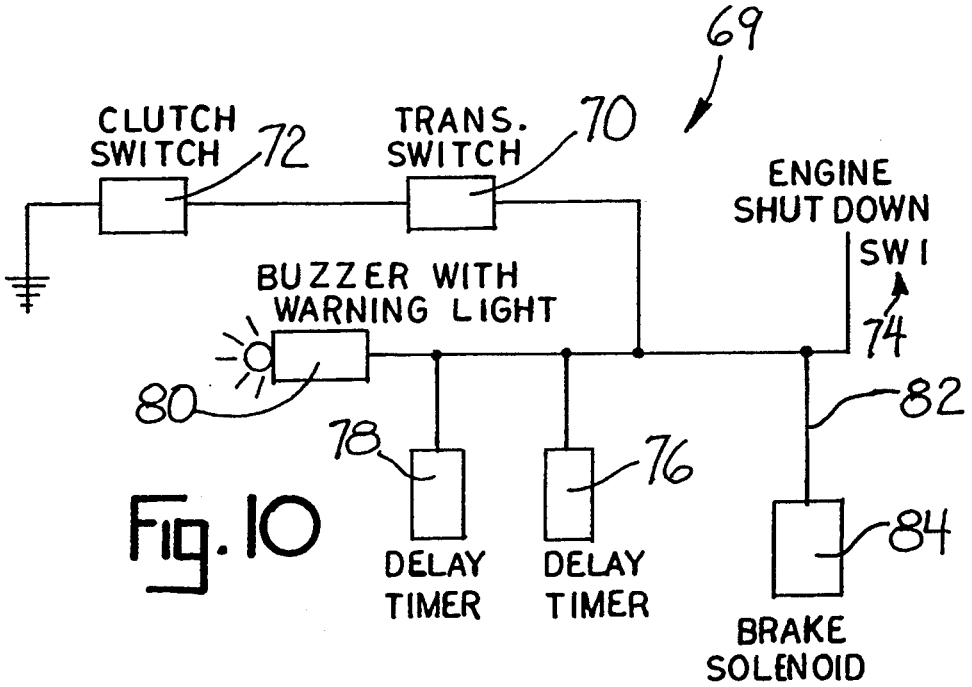
FIG. 10 is a schematic representation of a third embodiment of the drill rig.

FIGS. 9 and 10 illustrate a schematic representation of a second embodiment 68 of the invention. In this embodiment, a switch 70 is connected to the transmission (26 in FIGS. 1–5) and a switch 72 is connected to the clutch (not shown). Each switch 70, 72 is normally open senses the position of the gear selector and the status of the clutch. Switch 70 closes when the transmission is shifted out of neutral and switch 72 closes when the clutch is disengaged. Switches 70, 72 are electrically connected to engine kill switch 74 and one or more timers (two shown 76 and 78). In addition a warning buzzer/light combination 80 may be connected along the circuit as shown.

Embodiment 68 operates to shut down the drive engine 60 when the clutch is disengaged and the transmission is not in neutral after a time interval programmed into delay timers 76, 78. This prevents accidents which often occur when drill operators simply disengage the clutch (usually activated by a spring loaded lever positioned near the drill spindle) without shifting the transmission into neutral. Accidental engagement of the clutch may now cause an accident.

If the above situation (clutch disengaged and transmission not in neutral) switches 70, 72 closes, sending an electrical impulse to timer 76. After a short predetermined interval, usually 1–4 seconds, the timer 76 sends a signal to buzzer/light 80 to warn the drill operator of the situation. Timer 76 also sends a signal to timer 78 which, after another short predetermined interval, again about 1–4 seconds sends an impulse to kill switch 74 to shut off engine 60. If the operator engages the clutch or shifts the transmission into neutral prior to engine shut-off, the timers 76, 78 reset.

FIG. 10 illustrates circuit 69, which includes a connection via lead 82 to brake solenoid 84. In this embodiment, timer 78 also signals brake solenoid 84 to activate spindle brake (64 in FIGS. 1–5) to immediately prevent rotation of the spindle as well as shutting down power to engine 60. The operation is the same as the circuit 68 with the above additional feature.

The invention thus described is not limited to the scope of the abovegiven details, but may be modified within the scope of the following claims.

What is claimed is:

1. In a drill rig including a support frame, a spindle rotatably connected to said support frame, means for rotating said spindle relative to said support frame, the improvement comprising a barrier pivotally connected to said support frame for movement relative to the support frame between an open position exposing said spindle and a closed position substantially surrounding said spindle, said barrier including fastener means for securing said barrier to said support frame when the barrier is in its said closed position, sensor means associated with said barrier and support frame for sensing the position of said barrier, and switch means operably connected to said means for rotating and said sensor means wherein said spindle is automatically stopped when the barrier is not secured to said support frame.

2. The drill rig of claim 1 wherein said fastener means includes a key carried by said barrier, said support frame defining a keyhole, said sensor means positioned in said keyhole for sensing the presence or lack of presence of said key in said keyhole.

3. The drill rig of claim 2 wherein said switch means is in a normally closed position and is operably connected to a kill switch, said kill switch operably connected to said means for rotating.

4. The drill rig of claim 3 and a second switch means connected in series between said first-mentioned switch means and said kill switch, second sensor means connected between said second switch means and said means for rotating wherein said kill switch is actuated when the barrier is not in the closed position and said means for rotating is not in a neutral position.

5. The drill rig of claim 4 and a brake connected to said spindle for stopping rotation thereof, means for actuating said brake connected in series between said second switch means and said brake wherein said brake is actuated when the barrier is not in the closed position and said means for rotating is not in a neutral position.

6. The drill rig of claim 2 wherein said barrier includes a first barrier part, and a second barrier part slidably connected to said first barrier part, said second barrier part carrying said key wherein said key may be fitted into said keyhole only when the second barrier part is in a down position.

7. The drill rig of claim 2 wherein said barrier includes a first barrier part pivotally connected to said support frame, a second barrier part pivotally connected to said first barrier part, and a third barrier part pivotally connected to said second barrier part, said key connected to said third barrier part.

8. The drill rig of claim 2 wherein said key includes a turn handle.

9. The drill of claim 8 and a biasing means associated with said key for urging said key out of said keyhole.

* * * * *